United States Patent [19]

Hall et al.

[11] Patent Number: 4,562,324

[45] Date of Patent: Dec. 31, 1985

[54] ELECTRICAL CONTACT FOR USE IN A CURRENT-INTERRUPTING UNIT

[75] Inventors: Walter J. Hall; Raymond P. O'Leary, both of Evanston, Ill.

[73] Assignee: S&C Electric Company, Chicago, Ill.

[21] Appl. No.: 594,714

[22] Filed: Mar. 29, 1984

Related U.S. Application Data

[63] Continuation of Ser. No. 415,761, Sep. 7, 1982, abandoned.

[51] Int. Cl.[4] ..... H01H 1/44

[52] U.S. Cl. ..... 200/260; 200/258; 200/164 R

[58] Field of Search ..... 200/258, 260, 163, 286, 200/287, 149 A, 149 R, 51.09, 51.1, 164, 251, 259

[56] References Cited

U.S. PATENT DOCUMENTS

| | | | |
|---|---|---|---|
| 2,179,636 | 11/1939 | Koehler | 200/260 X |
| 2,458,792 | 1/1949 | Nigland | 200/163 X |
| 2,580,291 | 12/1951 | Friedrich et al. | 200/260 X |
| 2,816,978 | 12/1957 | Lindell | 200/146 R |
| 2,816,982 | 12/1957 | Barta | 200/146 R |
| 2,816,994 | 12/1957 | Mikos | 200/149 |
| 3,009,043 | 11/1961 | Goodwin, Jr. et al. | 200/260 X |
| 3,127,492 | 3/1964 | Date | 200/258 |
| 3,526,736 | 9/1970 | Rampath | 200/258 |
| 3,560,688 | 2/1971 | Bachler | 200/278 |
| 4,087,668 | 5/1978 | Nakanishi et al. | 200/260 X |
| 4,192,572 | 3/1980 | Stanger et al. | 200/149 A X |
| 4,271,339 | 6/1981 | Meister et al. | 200/144 C |
| 4,345,129 | 8/1982 | Czech et al. | 200/163 |
| 4,427,862 | 1/1984 | Lin | 200/252 |

FOREIGN PATENT DOCUMENTS

| | | | |
|---|---|---|---|
| 1110272 | 6/1961 | Fed. Rep. of Germany | 200/287 |
| 1166337 | 3/1964 | Fed. Rep. of Germany | 200/260 |
| 41953 | 5/1959 | Poland | 200/260 |

*Primary Examiner*—Stephen Marcus
*Assistant Examiner*—Ernest G. Cusick
*Attorney, Agent, or Firm*—Kirkland & Ellis

[57] ABSTRACT

A female interrupting contact for a current-interrupting unit includes a smoothly contoured, apertured pressure ring which is held in a groove formed in the wall of a bore through a contact body. A spring in the groove maintains the ring to one side of the bore so that the aperture is normally misaligned with the path of a male contact through the bore. When the male contact enters the aperture, it moves the ring against the action of the spring to align the aperture with its path. This alignment effects intimate sliding engagement between the male contact and both the ring and the wall of the bore, one or both of the latter of which are conductive so that a reliable electrical path through the contacts and the interrupting unit is established.

21 Claims, 8 Drawing Figures

12
2
2
10
14
16
18
18c
20
22
24
26
28
30
50
52
58
62
66
70
72
74
80
82
84
86
88
90
92
94
96
98
100
102
104
106
108
109
110
112
114
130
132
134
136
138
140
144
150
152

ELECTRICAL CONTACT FOR USE IN A CURRENT-INTERRUPTING UNIT

This is a continuation of application Ser. No. 415,761, filed Sept. 7, 1982 now abandoned.

BACKGROUND OF THE INVENTION

1. Field of the Invention

The present invention relates to an improved electrical contact for use in a current-interrupting unit and, more specifically, to an improved female electrical contact structure for a current-interrupting unit of a circuit interrupter. Even more specifically, the present invention relates to an improved female interrupting contact for a high-voltage current-interrupting unit usable in or as a circuit interrupter.

2. Brief Discussion of the Prior Art

Numerous types of circuit interrupters are well known. One type of circuit interrupter utilizes a disconnect switch, which includes a blade movable between closed and open positions relative to a stationary contact. Typically, the blade is pivotally mounted for opening and closing movement on a hinge which is carried by a first insulator, and the stationary contact is carried by a second insulator spaced from the first insulator. The hinge is electrically connectable to one side of a circuit or line and the stationary contact is electrically connectable to the other side of the circuit or line so that, with the blade closed, it engages the stationary contact and the circuit or line is continuous. When the blade is open, it disengages and separates from the stationary contact, and the circuit or line is discontinuous or interrupted.

When a circuit interrupter including such a switch is intended to render discontinuous an energized high-voltage circuit or line, it must typically have loadbreak capability. That is, upon opening of the switch, load current or other current flowing in the circuit or line must be broken. Loadbreak capability requires that the switch, or other circuit interrupter, have the ability to extinguish the high-voltage arc which necessarily forms when an energized, high-voltage circuit or line is opened. To this end, a circuit interrupter, such as a loadbreak switch, typically includes a current-interrupting unit. The current-interrupting unit may be stationarily mounted so that the blade swings relative thereto during its opening and closing movement. When the blade is closed, the interrupting unit may be either (a) connected in electrical parallel with the blade, in which case the majority of the current usually flows through the blade and the stationary contact because of the lower electrical resistance thereof, or (b) electrically discontinuous from the blade and the stationary contact so that it carries no current. In either event, as opening of the blade is initiated, facilities cause the current formerly flowing in the blade and the stationary contact to flow through the interrupting unit alone.

The interrupting unit includes interrupting contacts, one of which is (or may be made) electrically continuous with the stationary contact, while the other of which is (or may be made) electrically continuous with the blade. As the blade continues to open, the interrupting contacts separate, resulting in the formation of a high-voltage arc therebetween, which prevents or eliminates the formation of any such arc between the separating blade and stationary contact. As the blade moves well away from the stationary contact, the arc between the interrupting contacts, which are typically maintained in an enclosed, controlled environment, is extinguished by one of a variety of techniques.

One technique for extinguishing the high-voltage arc which forms between the interrupting contacts is to move the contacts relatively apart while simultaneously interposing between the separating contacts an elongated insulative member called a trailer, which conformably moves through a bore in an insulative cylinder, called a liner. In such a trailer-liner interrupting unit, the trailer usually moves with one of the interrupting contacts, which also moves through the bore in the liner, while the liner and the other interrupting contact remain stationary. The trailer and liner are usually both made of, or include, a so-called arc-extinguishing material, such as horn fiber, boric acid, or various plastics such as those sold under the trademarks Delrin and Lucite. The arc which forms between the separating interrupting contacts is elongated by their separation and is constricted by the conformal engagement of the trailer with the bore of the liner. Moreover, the heat of the arc interacts with the trailer and the liner to evolve cooling, turbulent, de-ionizing gases therefrom. Arc elongation and constriction, combined with the cooling, turbulent and de-ionizing effects of the evolved gases, extinguish the arc, as is well known. Extinguishment of the arc results in interruption of current flow. When arc extinguishment occurs within the interrupting unit, the blade is sufficiently far from the stationary contact so that the dielectric strength of the air gap therebetween prevents the formation of an arc therein to thereby prevent re-initiation of current flow.

In interrupting units of the type described above, one of the interrupting contacts is usually stationary, while the other interrupting contact is movable with respect thereto. The movable contact, which may be a male contact, carries the trailer and typically moves through or out of the stationary contact, which may be a female contact, and into the bore of the liner, which may be located adjacent to an exit end of the female contact. Thus, both the male contact and the trailer are drawn through the stationary contact and the bore of the liner.

Another type of circuit interrupter utilizes an interrupting unit similar to that described above, and may take the form of a portable high-voltage loadbreak tool, for example, such as that sold under the registered trademark "Loadbuster" by S&C Electric Company of Chicago, Ill., the assignee of the present invention. Basically, such a portable loadbreak tool comprises an interrupting unit which is mountable to an insulated "hot stick." The loadbreak tool permits the opening under load conditions of high-voltage devices, such as cutouts or disconnects, which, while similar to the above-described switch, do not themselves possess loadbreak properties (i.e., lack an interrupting unit). Facilities, such as hooks, rings, or bails, are included with the interrupting unit so that, upon manipulation of the "hot stick," both the stationary contact and the blade of the cutout or disconnect are mechanically engaged thereby. This engagement is such as to electrically connect one interrupting contact to the stationary contact of the cutout or disconnect and the other interrupting contact to the blade, so that the interrupting unit may be electrically paralleled with the cutout or disconnect. Subsequent movement of the "hot stick" simultaneously effects disengagement of the blade from its stationary contact and causes separation of the interrupting contacts within the interrupting unit. Thus, as the blade disengages the stationary contact, the current formerly flowing therethrough is "forced" to flow through the interrupting unit of the loadbreak tool, and current is ultimately interrupted along the lines described above. After the cutout is opened, the hooks, etc. are disengaged therefrom for storage or further use of the loadbreak tool.

Whether used in a loadbreak switch, a portable loadbreak tool, or other type of circuit interrupter, at some point during the opening of the circuit interrupter, the interrupting unit must carry the full current formerly flowing in the switch, cutout, or disconnect. This ability to carry the full current requires that the interrupting contacts be firmly and positively, mechanically and electrically engaged prior to their separation. In prior art interrupting units, such mechanical and electrical engagement has been achieved by configuring the female, stationary contact as a hollow cylinder which has formed integrally therewith, or formed in one end thereof, a plurality of contact fingers which define a continuation of the cylinder's bore. The contact fingers may be biased inwardly toward the axis of the bore by appropriate formation thereof during manufacturing or by encircling them with one or more garter springs. The contact fingers, which have open cuts or spaced therebetween, must be somewhat flexible so that during movement of the male contact therepast and out of the bore during opening of the interrupting unit, the male contact is slidingly, positively mechanically and electrically engaged by the fingers to ensure a low-resistance electrical path through the interrupting unit. The fingers must also be flexible in order to permit the male contact (and the trailer) to re-enter the bore of the female contact when the interrupting unit is closed.

The formation of the contact fingers is an expensive, time-consuming operation. The fingers may be formed by making an appropriate number of spaced, longitudinal cuts in one end of the hollow cylinder. Each cut must be accurately located and extended so that the fingers are all similarly flexible. The fingers may also be individually formed, which necessitates their accurate individual attachment to the hollow cylinder. Regardless of the manner in which the fingers are formed, each of them typically includes a conductive, refractory portion and a conductive, flexible portion. The refractory portion resists melting and the formation of asperities thereon by the arc, while the flexible portion permits sliding engagement of the fingers with the male contact. Each finger, therefore, requires attachment, as by brazing or welding, of the refractory portion to the flexible portion.

When prior art interrupting units are used over a period of time, the fingers sometimes break loose or fracture due to mechanical abuse, over-extended use during which one or more fingers become work-hardened, or damaged caused by the heat of the arcs which form between the interrupting contacts as the interrupting unit opens. The breaking or fracturing of one or more fingers may jam the interrupting unit so that it is unable to open or close.

Moreover, the cuts or spaces between the fingers result in the presence of a number of surfaces on which the arc forming between the separating interrupting contacts may "root." Electrical arcs tend to "root," or preferentially terminate, on sharp or pointed surfaces such as those presented by the adjacent edges of the fingers. The "rooting" of the arc on a non-refractory portion of one or more of the fingers may lead to the above-described finger breakage and may also cause asperities to form on the wall of the bore of the female contact, that is, either on the wall of the bore in the cylinder or on the continuation of the bore defined by the fingers. Such asperities can prevent free movement of the male contact (and the trailer) into and out of the female contact. Accordingly, the operation of the interrupting unit may be compromised.

In view of the above, one object of the present invention is the provision of an improved electrical contact for a interrupting unit which is simple and inexpensive to manufacture and which obviates the shortcomings of the above-described prior art contact. A further object of the present invention is the provision of an improved interrupting unit utilizing the improved electrical contact of the present invention which, along with other structure, leads to improved circuit interrupters which are more reliably operable.

SUMMARY OF THE INVENTION

With the above and other objects in view, the present invention relates to an improved first electrical contact for a circuit interrupter. The first electrical contact may be a stationary female contact of a current-interrupting unit in, or comprising, the circuit interrupter. The current-interrupting unit also includes a second contact. The contacts are relatively movable to engage and to disengage. The second contact may be a movable male contact which, to effect engagement between the contacts, enters or partially enters the first contact. As the contacts disengage, the second contact moves out of and away from the final contact. The first contact may be movable and the second contact may be stationary. Also both may be movable.

The improved first contact includes a body having a bore therethrough. Typically, the contact body and the wall of its bore are conductive. The bore is capable of receiving the second contact; the second contact is freely (somewhat loosely), and preferably conformably, movable along a path through the bore as relative contact movement takes place. The bore contains a groove which is preferably circumferential. A pressure ring, which may be conductive or non-conductive, is situated in the groove. The pressure ring is prevented from moving longitudinally along the bore and is held in the groove for limited shifting transversely of the bore and of the path of the second contact. The pressure ring has an aperture which is alignable with the path of the second contact due to the shiftability of the pressure ring. The aperture is capable of closely, and preferably conformably, receiving the second contact for movement therethrough as relative contact movement take place.

Facilities are provided in the groove for normally biasing the pressure ring transversely of the bore. This normal location of the pressure ring positions a portion of the pressure ring in the path of the second contact as it moves through the bore. This normal location of the pressure ring also normally effects misalignment between the aperture and the path of the second contact. As the second contact moves through the bore and enters the misaligned aperture during relative contact movement, the pressure ring is shifted against the action of the biasing means. The shifting of the pressure ring substantially aligns the aperture with the path of the second contact. As a consequence, this alignment and the continued action of the biasing facility, as well as the close reception of the first contact by the aperture, thereafter effect intimate sliding engagement between the wall of the aperture and the second contact, as well as between the wall of the bore and the second contact. Whether or not the pressure ring is conductive, the latter intimate sliding engagement results in a good electrical path between the second contact and the body of the first contact. The intimate sliding engagement continues as long as the second contact is within the aperture. When the first contact leaves the aperture, the pressure ring returns to its normal location.

The groove and the pressure ring may be located intermediate the ends of the bore, although both may be located at or near either end of the bore. Also, the biasing facility preferably comprises a flat (i.e., prestressed plate) spring or compression leaf spring located in the groove and acting between the wall of the groove and the outside of the pressure ring. The pressure ring may be chamfered, bevelled, or rounded at the aperture to facilitate entry thereinto of the second contact into the misaligned aperture.

BREIF DESCRIPTION OF THE DRAWINGS

DETAILED DESCRIPTION

Figure 1:
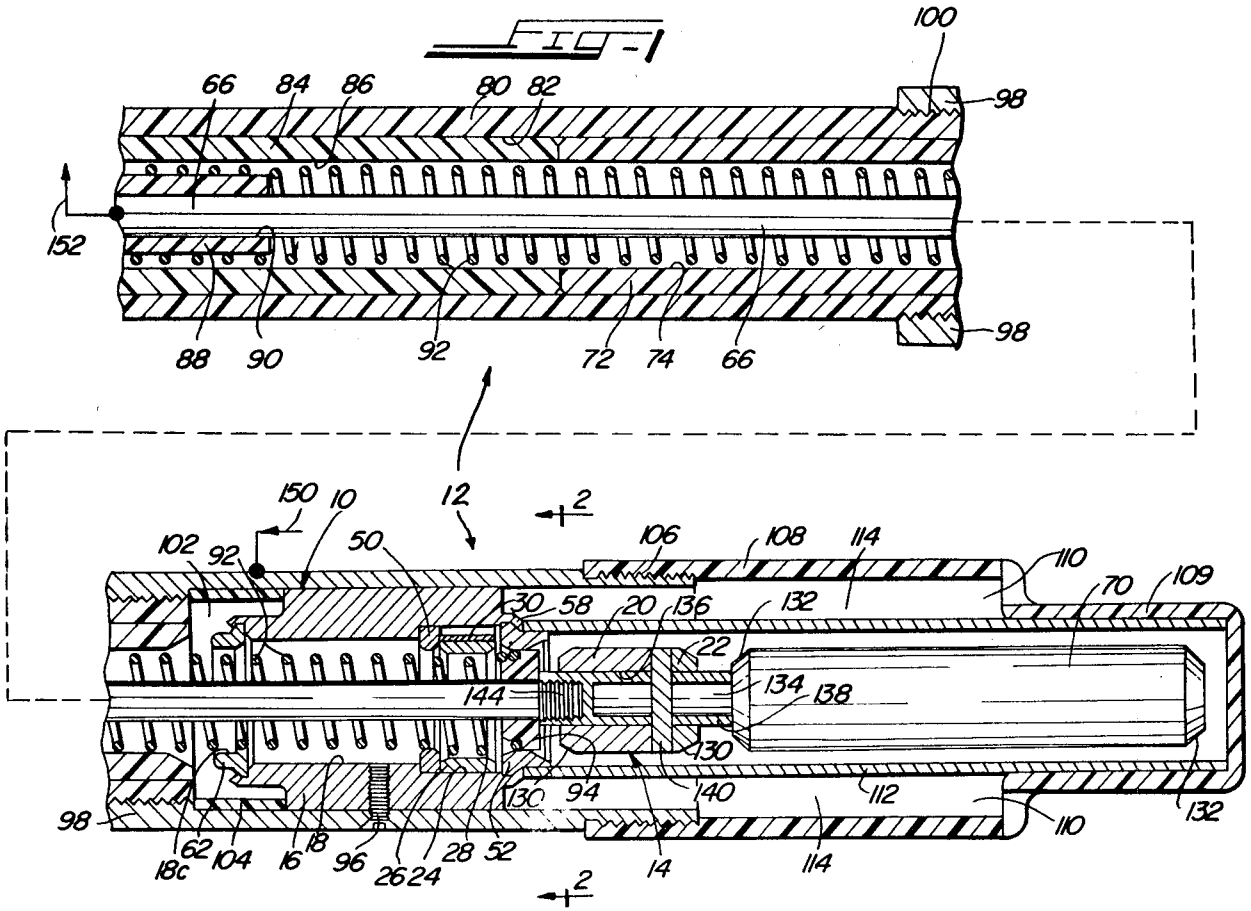
FIG. 1 is a side, partially sectioned view of an interrupting unit for a circuit interrupter which includes a preferred embodiment of an improved first contact according to the present invention.

Referring first to FIG. 1, there is shown a preferred embodiment of an improved first contact 10 according to the present invention. The first contact 10, which preferably constitutes a stationary female contact, is shown as one element of a current-interrupting unit, generally indicated by the reference numeral 12. The interrupting unit 12 may form a portion of, or be included with, any one of a wide variety of circuit interrupters, such as a loadbreak switch (not shown). The interrupting unit 12 may also form the major portion of a type of circuit interrupter, such as a portable loadbreak tool (not shown), typical of which is that sold under the registered trademark "Loadbuster" by the assignee of the present invention. The details of a preferred embodiment of the interrupting unit 12, as depicted in FIG. 1, are described below after the structure and operation of two alternative embodiments of the improved first contact 10 and certain other elements of the interrupting unit 12 are first described.

In addition to the improved first contact 10, the interrupting unit 12 includes a second contact 14. Typically, the second contact 14 is a movable male contact. The contacts 10 and 14 are relatively movable between an engaged position, whereat the male contact 14 is received by the female contact 10, and a disengaged position, whereat the male contact 14 moves out of and away from the female contact 10 following movement therethrough. Those skilled in the art will appreciated that the contact 10 may be movable and that the contact 14 may be stationary, or that both may be movable.

Figure 2:
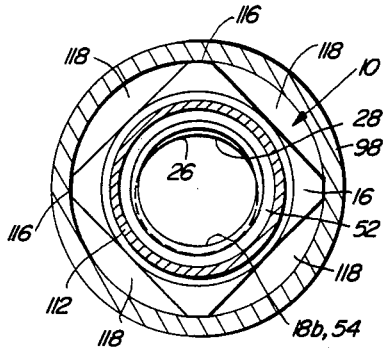
FIG. 2 is an end sectional view of the interrupting unit depicted in FIG. 1 which is taken along line 2—2 therein and which shows in greater detail a portion of the improved contact.
Figure 3:
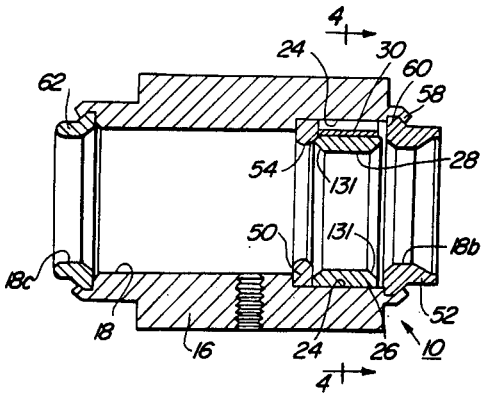
FIG. 3 is a side, sectional view of the improved contact shown in FIG. 1 with certain elements of the interrupting unit removed.

Referring to FIGS. 1–4, a preferred embodiment of the improved female contact 10 as used in the interrupting unit 12 may be seen to include a body 16 having a bore 18 formed therethrough. The contact body 16 is preferably formed of a conductive metal, such as brass, and is somewhat elongated, as depicted in FIGS. 1 and 3, although this elongation may be more or less than depicted in those FIGURES. Also, the bore 18 is preferably cylindrical and has a circular cross-section, although other cross-sections are contemplated.

Figure 5:
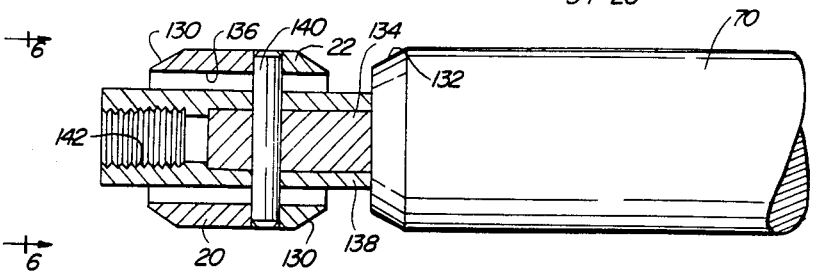
FIG. 5 is a side, partially sectioned view of a second contact present in the interrupting unit of FIG. 1 which cooperates with the improved contact depicted in FIGS. 1–4.

The male contact 14, which is only briefly described for the time being, may be seen, by referring to FIGS. 1 and 5, to comprise a generally cylindrical contact head 20 and a cylindrical arcing tip 22. The contact head 20 may be made of a conductive metal, such as copper, and the arcing tip 22 may be made of a refractory metal, such as tungsten or copper-tungsten. The contact head 20 and the arcing tip 22 may be attached by brazing, welding, or the like. As noted above, the cross-section of the bore 18 is preferably circular. The cross-sections of the contact head 20 and the arcing tip 22 are also preferably circular. If other cross-sections are used, the cross-sections of the bore 18 and of the contact head 20 and the arcing tip 22 are preferably complementary. The contact head 20 and the arcing tip 22 are receivable in and are freely movable through the bore 18, for example, by leftward movement thereof from the position shown in in FIG. 1. Regardless of the cross-sections of the bore 18 and of the contact head 20 and arcing tip 22, the contact head 20 and the arcing tip 22 are preferably loosely and conformably movable through the bore 18.

The bore 18 includes a groove or depression 24. Positioned within the groove 24 is a pressure ring 26 which may be made of a conductive metal such as copper, a refractory metal such as copper-tungsten, or an insulative material. Preferably, the groove 24 is circumferentially formed in the wall of the bore 18 coaxially therewith, and when the latter takes its preferred circular cross-section, the pressure ring 26 is preferably an annulus. The groove 24 need not be circumferential and coaxial, and may be formed only in one or more portions of the wall of the bore 18, in which event the pressure ring 26 may have a non-circular periphery. The outside of the pressure ring 26 is sufficiently smaller than the diametric size of the groove 24, or is otherwise configured so that the pressure ring 26 may be shifted or moved a limited amount within the groove 24 transversely or laterally of the bore 18 and of the path taken by the contact 14 through the bore 18.

Because of this construction, in one preferred embodiment the pressure ring 26 will be shifted within the groove 24 in the same "linear" direction. By use of this term in the claims, applicants mean that in this embodiment all points of the pressure ring 26 will substantially move in a single direction parallel to any one of the infinite number of radii of pressure ring 26. As reflected in other claims, and as those in the art will appreciate, other embodiments of the invention may not have this "linearity".

The pressure ring 26 contains an aperture 28 therethrough, which is preferably centrally located therein, but need not be. The inside diameter of the aperture 28 is only slighly larger than the outside diameters of the contact head 20 and the arcing tip 22 so that the contact 14 is closely receivable in the aperture 28. The cross-section of the aperture 28 is preferably complementary to that of the contact head 20 and the arcing tip 22, so that the aperture 28 may closely, conformably receive the contact 14. Also, the inside diameter of the aperture 28 is preferably equal to or is somewhat smaller than the inside diameter of the bore 18. Movement of the pressure ring 26 along the bore 18 is prevented by facilities discussed in greater detail below after the general structure and function of the improved contact 10 are described.

Figure 4:
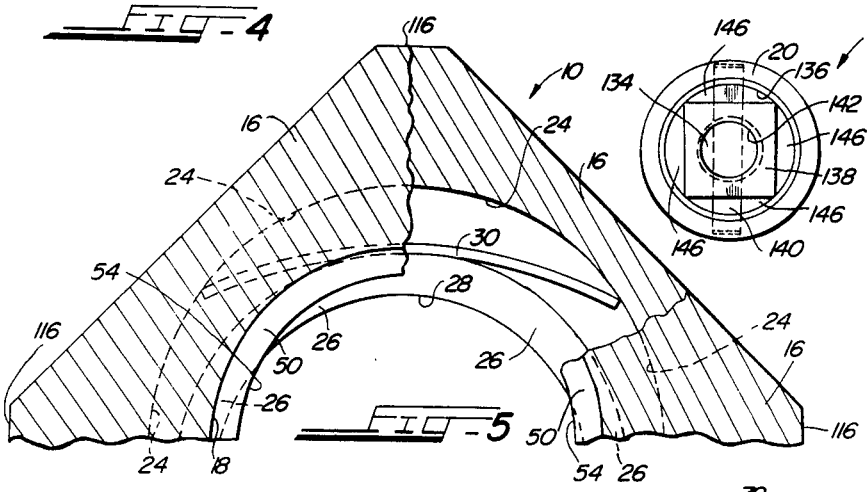
FIG. 4 is a partial, sectional end view of the improved contact depicted in FIG. 3 which is taken along line 4—4 therein.

As best seen in FIG. 4 (see also FIGS. 1 and 3), located within the groove 24 is a spring 30 which, preferably, takes the form of a single- or multi-layered flat (i.e., prestressed plate) or leaf spring made of beryllium-copper or the like. As shown in FIG. 4, the spring 30 is bowed out of its normal flat state by abutment of the pressure ring 26 therewith and abutment of its ends with the wall of the groove 24. Accordingly, the ends of the leaf spring 30 act against the wall of the groove 24, and the body of the spring 30 acts agaisnt the outside of the pressure ring 26. As shown in FIGS. 1–4, this action of the spring 30 causes the pressure ring 26 to be normally biased, transversely or laterally of both the bore 18 and the path of the contact 14 therethrough and to one side of the groove 24. This normal location of the pressure ring 26 positions a portion thereof in the path of the contact 14 through the bore 18 and also misaligns the aperture 28 relative to the path of the contact 14 through the bore 18. As a consequence, if the contact 14 is initially positioned to the right of the body 16, as depicted in FIG. 1, and is thereafter caused to move leftwardly during operation of the interrupting unit 12, the contact head 20 ultimately reaches the pressure ring 26. At this point, the contact head 20 begins to enter the aperture 28, and, as it does, engagement between the contact head 20 and the left end of the aperture 28 moves the pressure ring 26 against the action of the spring 30 until the aperture 28 is substantially aligned with the contact 14 and its path through the bore 18. This alignment of the pressure ring 26 due to entry of the contact head 20 into the aperture 28 plus the continued biasing action of the spring 30 effect intimate, firm and positive sliding engagement between the wall of the aperture 28 and the contact head 20. As the contact 14 continues to move leftwardly, intimate sliding engagement between the wall of the aperture 28 and the arcing tip 22 is also effected. The continued biasing action of the spring 30 on the pressure ring 26 also effects intimate, firm and positive sliding engagement between the contact head 20 and the wall of the bore 18 on either side of the pressure ring 26. Further, depending on the length of the contact 14 and the extent of the pressure ring 26 along the axis of the bore 18, such alignment of the aperture 28 with the contact 14 against the action of the spring 30 may effect intimate sliding engagement between the wall of the bore 18 (to the right of the pressure ring 26) and the arcing tip 22, before the arcing tip 22 reaches the pressure ring 26. As should be clear, the intimate sliding engagement between the contact head 20 (or the arcing tip 22) and the wall of the aperture 28 occurs on a side of the pressure ring 26 generally proximate to the spring 30. The intimate sliding engagement between the contact head 20 (or the arcing tip 22) and the wall of the bore 18 occurs on a side of the bore 18 remote from the spring 30 which is generally diametrically opposite from the engagement of the spring 30 with the pressure ring 26.

If both the pressure ring 26 and the contact body 16 are conductive, this intimate sliding engagement effects a reliable, low-resistance electrical path between the contact 14 and both the contact body 16 and the pressure ring 26. Should current be supplied to the contact 10 via electrical connection to the contact body 16, as described below, such results in the contact body 16, the pressure ring 26, and the spring 30 carrying current. If the pressure ring 26 is not conductive, a reliable, low-resistance electrical path between the contact 14 and the contact body 16 still results from the intimate sliding engagement, but the spring 30 will not carry current, which may be desirable so as to prevent its biasing action from being altered by the heating effect of current flow therethrough.

The simple expedient of positioning the normally misaligned pressure ring 26 and the spring 30 in the groove 24 achieves intimate, firm and positive sliding engagement between the contact 14 and the contact 10. Since the pressure ring 26 is a smooth member (annulus or otherwise) having no fingers, it is simple and inexpensive to fabricate and contains no elements (fingers) which may break or fracture to the detriment of the interrupting unit 12. Further, the absence of cuts or spaces, as are present between the fingers of prior art female contacts, eliminates any sharp corners or points on which an arc forming between the pressure ring 26 and the arcing tip 22 will "root" or preferentially terminate. The use of the pressure ring 26 eliminates the need for flexible fingers, and the spring 30 is shielded by the pressure ring 26 from direct exposure to any arc. As should be clear then, a current path through the interrupting unit 12 may be established by the above described intimate sliding engagement in a convenient, inexpensive manner, by which the operation of the unit 12 is less likely to be compromised.

As viewed in FIG. 1, continued leftward movement of the contact 14 ultimately carries the contact 14 through the bore 18 and to the left of and beyond the body 16. At this point, the contacts 10 and 12 are completely disengaged and circuit interruption, as described generally above and in more detail below, takes place.

Figure 7:
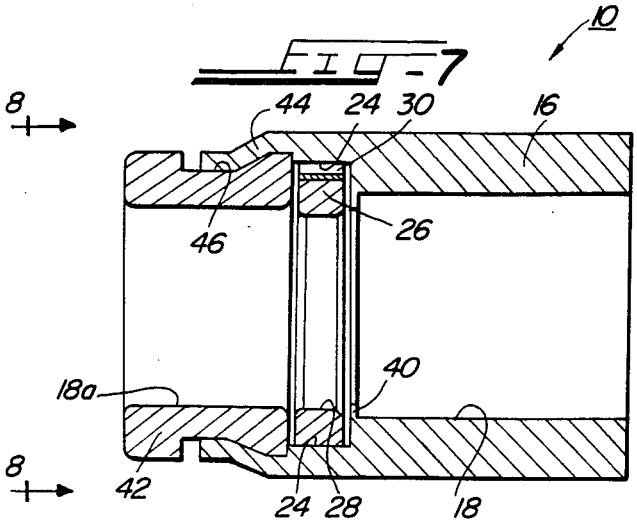
FIG. 7 is a side, sectional view of an alternative embodiment of the improved contact shown in FIGS. 1–4.

Turning now to FIG. 7, a less complicated, alternative embodiment of the improved contact 10 according to the present invention is depicted. The reference numerals of FIG. 1, where applicable, have been used in FIG. 7.

Figure 8:
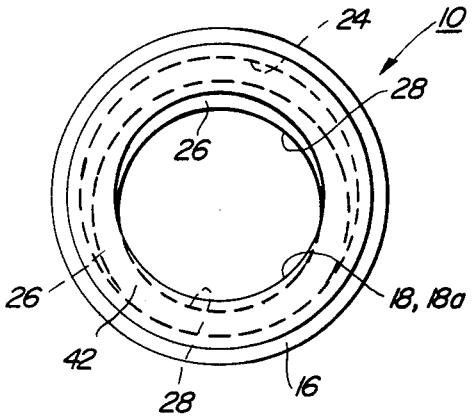
FIG. 8 is an end view of the contact depicted in FIG. 7.

As can be seen in FIG. 7, the pressure ring 26 may be prevented from moving along the bore 18 in the contact body 16 by an inwardly directed flange 40 formed on the wall of the bore 18 at one side of the ring 26. If desired, the flange 40 may be eliminated; the right side of the ring 26 may be held against longitudinal movement by the right end of the groove 24. The other side of the pressure ring 26 may be held in place by the end of an arcing contact 42 made of a refractory metal such as copper-tungsten. The arcing contact 42 contains a bore portion **18*a* which is a continuation of, and is aligned and continuous with, the bore 18. The arcing contact 42 may be attached to the contact body 16 by crimping or otherwise forming a flange 44 at the right end of the body 16 into an annular depression 46 formed on the exterior of the arcing contact 42. FIG. 8 depicts the contact 10 with the pressure ring 26** in its misaligned, normal location.

If the improved contact 10 shown in FIG. 7 is used in an electrical device, such as the interrupting unit 12 of FIG. 1, movement of the contact 14 (not shown in FIG. 7) during operation is from right to left. The contacts 10 and 14 may initially be out of engagement. As the contact 14 enters the bore 18 and then the aperture 28 in the pressure ring 26, the above-described alignment of the pressure ring 26 and the action of the spring 30 cause the contact head 20 to be in intimate sliding engagement with the all of the aperture 28, as well as with the wall of the bore 18,18*a*. This intimate sliding engagement established a reliable electrical path through the contacts 10 and 14 (which are connected to opposite sides of a circuit or line), and through the interrupting unit 12 during its operation. As continued leftward movement of the contact 14 continues, the contact head 20 and the arcing tip 22 ultimately exit the bore 18*a* and being to move away from the arcing contact 42. Any arc which thereafter forms between the arcing tip 22 of the contact 14 and the arcing contact 42 is ultimately extinguished, in a manner described below, to interrupt current flowing in the interrupting unit 12.

This sequence—intimate engagement between the contacts 10 and 14 due to the action of the pressure ring 26 and the spring 30, followed by movement of the arcing tip 22 away from the arcing contact 42—is typical of any type of circuit interrupter with which the unit 12 containing the improved contact 10 is used. If it is desried that the unit 12 be normally electrically paralleled with other elements of the circuit interrupter, for example, with the blade and the engaged stationary contact of a switch, the contact 14 may be normally positioned in the bore 18 with the contact head 20 already within the aperture 28. If the unit 12 is to be normally electrically discontinuous with the blade and the engaged stationary contact of the switch or with other elements, the contact 14 may be normally positioned out of the bore 18 and to the right of the body 16, as shown in FIG. 1.

While FIGS. 7 and 8 represent a simplified embodiment of the improved contact 10 according to the present invention, a preferred embodiment of the improved contact 10 is depicted in FIGS. 1–4. In FIG. 7 the pressure ring 26 of the improved contact 10 is at the left of the bore 18 and the male contact 14 is moved from right to left, starting either at the right of the body 16 or from within the bore 18, and thereafter moving through and out of the bore 18, the aperture 28, and the bore 18*a*. For reasons to be discussed below, in the preferred embodiment of the improved contact 10 shown in FIGS. 1–4, while the male contact 14 may move leftwardly and begin its movement from the right of the body 16 outside the bore 18, the pressure ring 26 is positioned at the right end of the contact body 16 rather than at the left end.

Referring now to FIG. 3, the preferred contact 10 may be seen to include the body 16 having the bore 18, the circumferential groove 24, the pressure ring 26 with its aperture 28, and the spring 30, all as described previously. The pressure ring 26 is located in the groove 24 at the right end of the bore 18. Longitudinal movement of the pressure ring 26 in the bore 18 is prevented by a strike ring 50 and a retainer 52. The strike ring 50, which may be made of copper alloy, is press fitted into the circumferential groove 24, which is extended longitudinally to the left along the bore 18 of the contact body 16 to this end. The strike ring 50 has a hole 54 therethrough, preferably of the same diametric size as the aperture 28. The retainer 52, which may also be made of copper alloy, defines a bore 18*b* which is a continuation of the bore 18 and is aligned therewith, but which preferably has a slighlty smaller diameter therethan. The retainer 52 may be held to the contact body 16 by deforming a flange 58 of the body 16 over an annular lip 60 on the retainer 52. The inside diameters of the hole 54, the aperture 28, and the bore 18*b* may be the same and all are preferably smaller than the diameter of the bore 18.

At the left end of the body 16, an arcing contact 62, similar to the arcing contact 42, is mounted. The arcing contact 62 is preferably made of tungsten-copper and defines a bore 18*c* therethrough. The bore 18*c* is a continuation of, and is aligned with, the bore 18 so that the bores 18, 18*b*, and 18*c*, in effect, form a continuous path for the male contact 14. In preferred embodiments, the inside diameter of the bore 18*c* is somewhere is size between the inside diameter of the bore 18 and the inside diameters of the aperture 28, the hole 54, and the bore 18*b*.

Although those skilled in the art will appreciate that the elements so far described may have various dimensions, a specific embodiment of the improved contact 10, the elements of which have the following dimensions, has been successfully used and tested in an interrupter 12 with an interrupting rating of 2000 amperes at a voltage of 17 kv and in an interrupter 12 with an interrupting rating of 1200 amperes at a volage of 29 kv:

| Approximate Dimensions (in inches) | |
|---|---|
| O.D. of Contact 14 | .740–.745 |
| Length of Contact 14 | 1 1/16 |
| ID of Bore 18 | .937 |
| Length of Bore 18 between elements 52 & 62 | 1⅛ |
| Length of Bore 18 between elements 50 & 62 | 1 9/32 |
| ID of Groove 24 | 1.068–1.069 |
| Length of Groove 24 | .577–.587 |
| OD of Strike Ring 50 | 1.069–1.070 |
| Thickness of Strike Ring 50 | .123–.127 |
| ID of Hole 54 | .780–.785 |
| OD of Ring 26 | .958–.962 |
| Thickness of Ring 26 | .430–.440 |
| ID of Aperture 28 | .780–.785 |
| ID of Bore 18b | .780–.785 |
| ID of Bore 18c | .810–.820 |
| Total Length of Bores 18, 18b & 18c | 2 15/32 |

As best illustrated in FIG. 1, where the interrupting unit 12 is used in conjunction with a switch or the like, it may be preferred that the interrupting unit 12 carry no current in the normally closed position of the switch and be electrically discontinuous from the blade and stationary contact thereof. As a consequence, the male contact 14 may be normally positioned slightly rightwardly of the retainer 52 so that it makes no electrical contact with the female contact 10. In response to the opening of the interrupter switch, a pull rod 66 attached to the male contact 14 is moved leftwardly. After some amount of leftward movement, the contact head 20 enters the bore 18*b* and, subsequently, enters the aperture 28 in the pressure ring 26. As described previously, entry of the contact head 20 into the aperture 28 substantially aligns the aperture 28 with the path of the contact 14, and that alignment, in conjunction with the continuing action of the leaf spring 30, effects intimate sliding engagement between the contact head 20 and the wall of the aperture 28. Also, the joint action of the aligned pressure ring 26 and the spring 30 cause the contact head 20 to intimately slidingly engage either the wall of the bore 18*b* or the wall of the hole 54, or both, as leftward movement of the contact 14 continues. When the contact head 20 is in intimate sliding engagement with the walls of the aperture 28, the hole 54 and the bore 18*b*, reliable mechanical and electrical contact between the contacts 10 and 14 is effected. Accordingly, at this time, the unit 12 carries all of the current formerly flowing in the switch or other device with which it is used via a current path which includes the body 16 of the contact 10, the strike ring 50 and the retainer 52 (as well as the pressure ring 26 and the spring 30, if the former is conductive), the contact head 20, and the pull rod 66.

While the contact 14 intimately engages the walls of the aperture 28, the hole 54, and the bore 18*b* no arcing within the interrupting unit 12 occurs because of the resulting metal-to-metal contact. If the interrupting unit 12 is used with a switch, as the contact 14 moves leftwardly of the pressure ring 26 and the strike ring 50, the blade of the switch continues to move away from its stationary contact. This movement of the blade continues as the contact 14 moves through the bore 18 of the contact body 16 to the left of the strike ring 50.

The bore 18 is elongated to the left of the strike ring 50 to ensure that sufficient gap exists between the blade and its stationary contact before the interrupting unit 12 extinguishes any arc that forms. Specifically, as the contact 14 moves through the bore 18 (and the switch continues opening), the diametrical clearance therebetween is sufficiently small so that, although metal-to-metal contact therebetween may not continuously occur (in FIGS. 1 and 3, the diameter of the bore 18 is larger than that of the contact 14), one or more small arcs or arclets form between the contact 14 and the wall of the bore 18, thus maintaining the contact head 20 and the contact body 16 in effective electrical contact (via the small arcs or arclets) during the time the contact 14 travels through the bore 18. Preferably, the clearance between the contact 14 and the bore 18 is sufficiently small so that extinguishment of the small arcs or arclets does not occur while the contact 14 is in the bore 18. The clearance is, nevertheless, sufficiently large so that any small asperities formed on the wall of the bore 18 by the small arcs do not impede free movement of the contact 14 therethrough.

Thus, during the travel of the contact 14 through the bore 18, during which the unit 12 continues to carry current, the blade of the switch is able to move an additional amount away from its stationary contact so that when the interrupting unit 12 effects arc extinguishment, conduction by way of arcing or otherwise cannot be initiated between the blade and its stationary contact. Ultimately, the contact 14 moves to the left out of the bore 18*c* in the arcing contact 62 and, ultimately, clears and moves to the left of the arcing contact 62. As the contact 14 moves leftwardly of the arcing contact 62, arcing is initiated between the arcing tip 22 and the arcing contact 62.

Arcing which occurs between the arcing tip 22 and the arcing contact 62 may be extinguished by the action of a trailer 70 and a liner 72. As described in greater detail below, the trailer 70 is attached to te contact 14 and travels with the contact 14 through the contact 10 and the various elements thereof. The liner 72 is maintained in the interrupting unit 12 to the left of the arcing contact 62. The liner 72 contains a bore 74 which closely, conformably receives the contact 14 and the trailer 70 as the pull rod 66 moves the contact 14 and the trailer 70 leftwardly. Once the contact 14 and the trailer 70 enter the bore 74 in the liner 72, any arcing between the arcing tip 22 and the arcing contact 62 is constricted by the close diametric fit between the trailer 70 and the wall of the bore 74. Furthermore, the trailer and the liner are preferably made of an arc-extinguishing material, such as Lucite, Delrin, or any other material which evolves large quantities of turbulent, cooling, and de-ionizing gas when exposed to high heat, such as that generated by an arc. The constriction of the arc between the trailer 70 and the wall of the bore 74, the elongation of the arc due to the increasing separation between the arcing tip 22 and the arcing contact 62, and the turbulent, cooling, and de-ionizing effects of gases evolved from the trailer 70 and the liner 72 ultimately establish sufficient dielectric strength between the still separating arcing tip 22 and arcing contact 62 so that, at a current zero, arc extinguishment and current interruption are effected.

Although the improved contact 10, including the pressure ring 26 and the spring 30 as described above, may be used in any type of interrupting unit, the interrupting unit 12 depicted in FIG. 1 is one preferred use environment for such contact 10. Accordingly, further details of a preferred embodiment of the circuit-interrupting unit 12 are now described.

The interrupting unit 12, only a portion of which is shown in FIG. 1, may include an elongated and generally cylindrical insulative housing 80 having a central bore 82 therethrough. Lining a rightward portion of the bore 82 is the liner 72 with its bore 74. To the left of the liner 72 is a spring tube 84 made of an insulative, low-friction material. The spring tube 84 defines a central bore 86 which is continuous and aligned with the bore 74 of the liner 72. The pull rod 66 passes through the bores 74 and 86. The left end of the pull rod 66 may pass through an insulative guide tube 88 held in place by facilities (not shown) at the left end of the housing 80. The guide tube 88 defines a passageway 90 through which the pull rod 66 is slidingly movable for guiding the pull rod 66 and ensuring that its movement, and the movement of the contact 14, is generally along the axes of the bores 18, 74, and 82.

Surrounding the pull rod 66 and the guide tube 88 is a coiled, closing compression spring 92. The left end of the closing spring 92 may act against an insulative lip, flange or other feature (not shown) formed at the left end of the guide tube 88. The right end of the closing spring 92 may act against an insulative bumper 94 made of a plastic or similar insulative material which is mounted on the right end of the pull rod 66 adjacent the contact 14. The bumper 94 is freely movable through the bore 18 of the contact 10 without interfering with movement of the pull rod 66 as it moves the contact 14 leftwardly. When the pull rod 66 is moved leftwardly to move the contact 14 leftwardly, the closing spring 92 is compressed. Such leftward movement of the pull rod 66 may be effected by connecting or engaging its left end (not shown) with appropriate linkages, cams or levers (not shown) which move the pull rod 66 in response, for example, to opening of the blade (not shown) of a switch or disconnect (not shown), which, together with the interrupting unit 12, constitutes a circuit interrupter. Following full leftward motion of the pull rod 66 and extinguishment of any arc forming between the arcing tip 22 and the arcing contact 62, as described above, the left end of the pull rod 66 is released by the linkages, cams or levers (not shown) which permit the closing spring 92, compressed by the leftward movement, to return the contact 14 to the position depicted in FIG. 1.

The spring 92 is maintained out of contact with the pull rod 66, as shown in FIG. 1. Further, the spring 92 is adjacent to or is supported by various insulative members 72, 84, 88 and 94 within the interrupting unit 12. Thus, with the contact 14 in its preferred normal position to the right of and out of engagement with the retainer 52 (FIG. 1) on the contact body 16 (FIG. 7), no continuous current path through the unit 12 is provided via the spring 92, even if one or more segments of the spring 92 engage the wall of the bore 18,18*b*,18*c* of the aperture 28, or of the hole 54. Moreover, when the spring 92 is compressed by full leftward movement of the pull rod 66, its coils are insulatively supported by the guide tube 88 so that current in the contact 14 flows only in the pull rod 66.

The outer periphery of the contact body 16 is mounted as convenient (for example, as with the use of a screw 96) within a tubular, metal housing 98. The metal housing 98 may be attached to the insulative housing 80 by telescopically threading the two housings 80 and 98 together, as generally shown at 100. An annular cavity 102 defined between the ends of the insulative housing 80 (and the liner 72) and the contact body 16 (including the arcing contact 62), and by the interior wall of the metal housing 98, may be lined with an insulative sleeve 104. The function of the sleeve 104 is to prevent erosion of the inside surface of the metal housing 98 by any arcing which occurs between the arcing tip 22 and the arcing contact 62. The metal housing 98 may be telescopically threaded onto, as shown generally at 106, a generally cylindrical exhaust control or muffler housing 108 made of an insulative material. The right end 109 of the exhaust control housing 108 may have a decreased diameter and contain a plurality of vent holes 110 around its periphery.

The left end of an open-ended trailer tube 112 is attached as convenient to the right end of the retainer 52 and abuts the end of the flange 58. The right end of the trailer tube 112 may be nested within the decreased diameter right end 109 of the muffler housing 108 which closes the right end of the trailer tube 112. Before operation of the interrupting unit 12 is initiated, both the trailer 70 and the contact 14 are positioned within the trailer tube 112. Accordingly, the trailer tube 112 is preferably made of an insulative material so that accidental engagement thereof by the contact 14 in its normal rightward position does not result in a continuous current path through the unit 12 via the housing 98, the contact body 16, the tube 112, the contact 14, and the pull rod 66. Since the trailer tube 112 contains no hole or openings, its right end is closed. Thus, the right end of the bore 18 (at the bore 18*b*) through the contact body 16 is closed by the trailer tube 112. Defined between the outside of the trailer tube 112 and the inside of both the exhaust control housing 108 (and the portion of the metal housing 98 to the right of the contact body 16), is an elongated, annular chamber 114. This chamber 114 communicates with the vent holes 110 for a purpose to be described below.

As best shown in FIG. 2, the exterior of the contact body 16 may have a generally square cross-section. Accordingly, the contact body 16 may be held within the metal housing 98 at four points about is periphery, generally designated 116. Further, as a consequence of the exterior of the contact body 16 having a square cross-section, there are defined, between the interior of the metal housing 98 and the exterior of the contact body 16, a plurality of elongated exhaust passages 118. While it is preferred that the exterior of the contact body 16 has a square cross-section and the metal housing 98 has a circular cross-section, other cross-sections may be used for either as long as one or more of the exhaust passages 118 are present. The exhaust passages 118 communicate with the annular cavity 102 and with the elongated, annular chamber 114 and, accordingly, with the vent holes 110.

When the interrupting unit 12 is operated, as described above, and the pull rod 66 moves the contact 14 leftwardly through the bore 18 of the contact 10, the small arcs or arclets first form between the contact 14 and the wall of the bore 18. These small arcs lead to the evolution of gases (primarily from vaporization of small quantities of the contact body 16 and the contact 14) which quickly pressurize the volume enclosed and defined by the bore 18*c*,18,18*b* and the trailer tube 112. More significant arcing ultimately occurs between the arcing tip 22 and the arcing contact 62. This arcing leads to the evolution of gases, both from vaporization of metal parts on which the arc terminates (typically the arcing tip 22 and the arcing contact 62), as well as from the trailer 70 and the liner 72 due to the heat of the arc. It has been found that if the gases resulting from such significant arcing are permitted to freely flow rightwardly through the bore 18*c*, 18, and 18*b* of the contact 10, any arc initially terminating or "rooting" on the arcing tip 22 and the arcing contact 62 may tend to be blown back into the bore 18*c*,18 thereafter terminating or "rooting" on the wall thereof. It is desired that any significant arcing which occurs terminate only on the arcing tip 22 and the arcing contact 62, which are preferably refractory and, hence, arc-resistant. The termination of a significant arc on the wall of the bore 18*c*,18 may create asperities or other surface irregularities on the walls of the bore 18*c*,18, the hole 54 in the strike ring 50, or the aperture 28 in the pressure ring 26. Such asperities or surface irregularities may impede or prevent free passage of the contact 14 and the trailer 70 through the contact 10 in either direction. This impediment to movement of the contact 14 may occur either during opening of the interruping unit 12 or closing thereof, but in any event, many compromise the desired function of the unit 12. To alleviate the problem of an arc being blown back into the bore 18*c*,18, the trailer tube 112 closes the right end of the bore 18, as noted earlier. Closure of the right end of the bore 18 obviates or eliminates the formation of asperities on the walls of the bore 18*c*,18, as well as elsewhere within the contact 10.

Specifically, as the contact 14 moves to the left of the arcing contact 62 and significant arcing is initiated between the arcing tip 22 and the arcing contact 62, gases which are evolved thereby cannot flow rightwardly through the bore 18*c*,18,18*b* and into the interior of the trailer tube 112 due to the earlier pressurization thereof by gases evolved by the small arcs or arclets when the contact 14 was within the bore 18. Consequently, the evolution of further gases by significant arcing between the arcing tip 22 and the arcing contact 62 results in the flow thereof from the annular cavity 102, through the exhaust passages 118, rightwardly into the elongated annular chamber 114, and through the vent holes 110. Thus, the initial pressurization of the interior of the trailer tube 112 and of the bore 18 due to the action of the small arcs or arclets prevents any significant rightward gas flow through the bore 18*c*,18. As a consequence, the majority of any gas evolved during operation of the interrupting unit 12 flows around the outside of the contact body 16 and rightwardly out of the vent holes 110. The provision of this flow path for evolved gases substantially eliminates any tendency of the gases to blow back the arc into the bore 18*c*,18. In order to ameliorate the effects of the evolved gases, which may be both high in temperature and highly ionized, the elongated annular chamber 114 may be filled with appropriate materials or substances which cool, condense and/or de-ionize these gases before they are vented to the atmosphere through the vent holes 110. For example, the elongated annular chamber 114 may be filled with copper or other metal mesh, activated charcoal, silica, or similar materials, as well as other devices (not shown). Appropriate materials, substances or devices for inclusion within the elongated annular chamber 114 are depicted in the following commonly assigned U.S. Pat. Nos. 4,001,750; 3,965,452; 3,909,570; 3,719,912; 3,391,368; and 3,230,331.

As already noted, a circuit interrupter may comprise the interrupting unit 12 used in conjuction with a switch (not shown). Where such use is contemplated, the pull rod 66 is moved in response to opening of the blade (not shown) of the switch to first carry current as opening of the blade is initiated and to thereafter effect arc extinguishment and current interruption after the blade has moved a sufficient distance from a stationary contact (not shown) to withstand, without the initiation of current flow, the application thereto of full circuit or line voltage. As shown in FIG. 1, in a preferred form of the interrupting unit 12, the contact 14 is, in the normal or rest position of the interrupting unit 12, not in mechanical or electrical engagement with the contact 10, and that unit 12 is, therefore, not normally electrically paralleled with the switch. If it is desired that the interrupting unit 12 be normally in electrical parallel with the blade and its stationary contact when the switch is closed, the length of the pull rod 66 (or the dimensions or positions of other elements) may be adjusted so that the contact 14 normally rests against, or is partially within, the aperture 28 of the pressure ring 26. Also, as described earlier, the interrupting unit 12 shown in FIG. 1 may form the major portion of a type of circuit interrupter comprising a portable loadbreak tool, such as that marketed under the trademark "Loadbuster" by the assignee of this invention. Those skilled in the art may refer to the following commonly assigned U.S. patents for purposes of determining the manner in which the interrupting unit 12 containing the improved contact 10 of the present invention may be substituted for the interrupting unit of such a portable loadbreak tool: U.S. Pat. Nos. 2,816,978; 2,816,980; 2,816,981; 2,816,982; 2,816,983; 2,816,984; 2,816,985; and 2,816,994.

Figure 6:
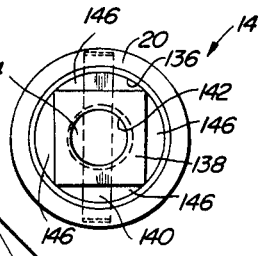
FIG. 6 is an end view of the movable contact depicted in FIG. 5 which is taken along line 6—6 therein.

Referring now to FIGS. 5 and 6, there is shown one embodiment of the male contact 14 usable with the improved contact 10 of the present invention. As already noted, the male contact 14 includes the contact head 20 and the arcing tip 22, which are preferably cylindrical in cross-section and may be connected together, as convenient, by brazing or the like. Both the contact head 20 and the arcing tip 22 may be beveled or chamfered as shown at 130 at both ends of the contact 14. These bevels 130 ensure that the contact head 20 may enter the aperture 28 in the pressure ring 26 when the pressure ring 26 is misaligned by the spring 30 with the path of the contact 14. The ends of the aperture 28 and the ends of the trailer 70 may also be chamfered or bevelled, as shown at 131 and 132, respectively, in FIGS. 1 and 3, to the same end.

The trailer 70, which may be formed by molding, carries a trailer rod 134. The trailer rod 134 is preferably attached to the trailer 70 during the molding thereof. An axial hole 136 is formed through the contact 14, portions of the hole 136 passing through both the contact head 20 and the arcing tip 22. Positioned within the hole 136 is a hollow contact support 138. The trailer rod 134 may be telescoped into the contact support 138 and the contact 14 may be mounted to the contact support 138 by a pin 140 which passes through appropriate cross-apertures in the contact 14, the contact support 138, and the trailer rod 134. The left end of the contact support 138 is internally threaded as shown at 142. The internal threads at 142 may be attached to threads 144 formed on the right end of the pull rod 66 for attaching the contact 14 and the trailer 70 to the pull rod 66.

As best shown in FIG. 6, the contact support 138 may have a square or other non-circular cross-section. As a consequence, there is defined between the outer periphery of the contact support 138 and the wall of the hole 136 through the contact 14 a plurality of channels 146. Just as it is desired that a significant arc not "root" on the wall of the bore 18*c*,18,18*b* of the contact 10, it is also preferred that such an arc extend between the arcing tip 22 and the arcing contact 62 and not "root" on the exterior, longitudinal surface of the contact 14. If a significant arc "roots" on this exterior surface, asperities may be formed thereon which prevents free movement of the contact 14 through the contact 10, the liner 72, or the spring tube 84.

Due to the presence of the channels 146, gases evolved by an arc between the arcing tip 22 and the arcing contact 62 pass through such channels 146 into the bore 86 of the spring tube 84. This passage of the gas through the channels 146 tends to ensure that the arc will be blown into and root on the walls of the channels 146 and not on the exterior surface of the contact 14 which is conformably received in the bore 74 of the liner 72.

If the contact 14 is within the improved contact 10 (either initially or after some leftward movement) and is in intimate mechanical and electrical engagement therewith due to its cooperation with the pressure ring 26, a reliable continuous first current path through the interrupting unit 12 is established. This first path includes, in order, the metal housing 98, the contact body 16, the strike ring 50 and the retainer 52, the contact head 20 and the arcing tip 22, the contact support 138 and the pin 140, and the pull rod 66. If the pressure ring 26 is conductive, it and the flat spring 30 are also in the first path. Electrical connections to the metal housing 98 and the pull rod 66, only generally depicted at 150 and 152, respectively, may be permanently made or may be selectively made in response to movement of the blade of a switch or other device with which the unit 12 is used to constitute a circuit interrupter. These connections can be achieved in a variety of ways and will depend on the type of circuit interrupter in which the interrupting unit 12 is used.

As the contact 14 moves through the bore 18,18*c* to the left of the strike ring 50, a second current path through the interrupting unit 12 is established. This second path includes, in order, the connection 150, the metal housing 98, the contact body 16, the small arcs or arclets between the wall of the bore 18 and the contact 14, the contact 14, the pull rod 66, and the connection 152. As the contact 14 moves out of the bore 18 and to the left of the contact 10, a third current path is established through the interrupting unit 12. This third path includes, in order, the connection 150, the metal housing 98, the arcing contact 62, the arc between the arcing contact 62 and the arcing tip 22, the pull rod 66, and the connection 152. The third path remains until the arc is extinguished as described above.

Since the connections 150 and 152 are in electrical parallel with the blade and stationary contact of a switch, cutout or the like (in parallel either permanently or as a result of the switch starting to open), establishment of the first path is preferably timed to occur just before or just as the switch or cutout opens (the blade physically separates from the stationary contact). Such parallel relationship and timing ensure that all current formerly flowing in the switch or cutout now flows in the interrupting unit 12 and that no significant, prolonged arc is established between the blade and stationary contact of the switch or cutout. The length of time that the second path is established may be set, for example, by adjusting the length of the bore 18 to the left of the strike ring 50. This length of time may be selected so that, in view of the voltage and current of the circuit or line in which the switch or cutout is used, there is a sufficient gap between the blade and the stationary contact thereof to prevent arcing therebetween when the interrupting unit 12 finally extinguishes the arc between the arcing tip 22 and the arcing contact 62.

As already noted, the interrupting unit 12 may be either (a) continuously electrically paralleled with a switch, cutout or other device, or (b) placed in electrical parallel therewith only after the switch or cutout begins to open, by appropriately selecting the normal position of the contact 14. In FIG. 1, the contact 14 normally does not engage the improved contact 10; thus condition (b) obtains. If condition (a) is desired, the pull rod 66 may be shortened so that the contact head 20 normally engages the pressure ring 26.

The use of the pressure ring 26 and the spring 30 permit the realization of the improved contact 10 which has a low cost and operates reliably. The positioning of the pressure ring 26 at or near the right end of the bore 18,18*b* and the lengthening of the bore 18 permit the improved contact 10 and the contact 14 to remain electrically continuous (via the small arcs or arclets) for some time after the contact 14 moves past the pressure ring 26. This expedient allows use of the interrupting unit 12 in a wide variety of circuit interrupters in which a sufficiently long gap, for example, between the blade and stationary contact of a switch, must be opened before the interrupting unit 12 extinguishes the arc between the arcing tip 22 and the arcing contact 62. The passages 118—resulting from the dissimilar shapes of the contact body 16 and the housing 98—prevent any significant arc between the arcing tip 22 and the arcing contact 62 from being blown by evolved gas back into the bore 18*c*,18,18*b*. The channels 146 similarly protect the exterior surface of the contact 14.

We claim:

1. A current interrupting unit having a first electrical contact and a second electrical contact, the contacts being relatively movable to engage and disengage; wherein the first electrical contact comprises:

a body having a bore, the second contact being receivable in, and freely movable along a path through, the bore as relative contact movement takes place, the wall of the bore containing a groove;

a pressure ring held in the groove for limited shifting therein transversely of the bore and of the path of the second contact, the pressure ring having an aperture which is alignable with the path of the second contact, due to the shiftability of the pressure ring, to closely receive the second contact for movement therethrough as relative contact movement takes place; and unidirectional bias means in the groove for normally biasing the entire pressure ring transversely of the bore in the same linear direction both to normally position at least a portion of the pressure ring in the path of the second contact and to normally effect axial misalignment between the aperture and the path of the second contact, entry of the second contact into the aperture shifting the pressure ring against the action of the biasing means to substantially axially align the aperture with the path of the second contact, such axial alignment and the action of the biasing means thereafter effecting intimate sliding engagement between the wall of the aperture and the second contact and between at least a portion of the wall of the bore and the second contact as long as the second contact is within the aperture.

2. A current interrupting unit having a first electrical contact and a cylindrical second electrical contact, the contacts being relatively movable to engage and disengage; wherein the first electrical contact comprises:

a body having a cylindrical bore, the second contact being receivable in, and freely movable along a path through and axially of, the bore as relative contact movement takes place, the wall of the bore containing a circumferential groove;

a pressure ring of constant aperture held in the groove for limited shifting therein transversely of the bore and of the path of the second contact, the pressure ring having a circular aperture which is axially alignable with the path of the second contact, due to the shiftability of the pressure ring, to closely receive the second contact for movement therethrough as relative contact movement takes place; and means in the groove for normally biasing the pressure ring transversely of the bore and to one side of the groove both to normally position at least a portion of the pressure ring in the path of the second contact and to normally effect axial misalignment between the aperture and the path of the second contact, entry of the second contact into the aperture shifting the pressure ring against the action of the biasing means to substantially axially align the aperture with the path of the second contact, such axial alignment and the action of the biasing means thereafter effecting intimate sliding engagement between the wall of the aperture and the second contact and between at least a portion of the wall of the bore and the second contact as long as the second contact is within the aperture.

3. A current interrupting unit having a first electrical contact and a second electrical contact, the contacts being relatively movable to engage and disengage; wherein the first electrical contact comprises:

a body having a bore with a cross-section complementary to the cross-section of the second contact, the second contact being loosely conformably receivable in, and freely movable along a path through, the bore as relative contact movement takes place, the wall of the bore containing a groove;

a pressure ring held in the groove for limited shifting therein transversely of the bore and of the path of the second contact, the pressure ring having an aperture with a cross-section complementary to the cross-section of the second contact, which aperture is alignable with the path of the second contact, due to the shiftability of the pressure ring, to closely conformably receive the second contact for movement therethrough as relative contact movement takes place; and unidirectional bias means in the groove for normally biasing the entire pressure ring transversely of the bore in the same linear direction both to normally position at least a portion of the pressure ring in the path of the second contact and to normally effect axial misalignment between the aperture and the path of the second contact, entry of the second contact into the aperture shifting the pressure ring against the action of the biasing means to substantially axially align the aperture with the path of the second contact, such axial alignment and the action of the biasing means thereafter effecting intimate sliding engagement between the wall of the aperture and the second contact and between at least a portion of the wall of the bore and the second contact as long as the second contact is within the aperture.

4. A current interrupting unit having a first female electrical contact and a generally cylindrical second male electrical contact having a first diameter, the contacts being relatively movable along longitudinal axes thereof between a closed position, whereat the male contact is within and engages the female contact, and an open, disengaged position; wherein the first electrical contact comprises:

an elongated body having a cylindrical bore with a second diameter, the second contact being receivable in, and freely, conformably movable along a path through and axially of the bore as relative contact movement takes place, the wall of the bore containing an annular, circumferential groove having a third diameter and being coaxial with the axis of the bore;

an annular pressure ring of constant aperture held in the groove for limited shifting therein transversely of the axis of the bore and of the path of the second contact, the pressure ring having a fourth diameter and a circular central aperture which is alignable with the axis of the bore and the path of the second contact, due to the shiftability of the pressure ring, to closely conformably receive the second contact for movement therethrough as relative contact movement takes place, the aperture having a fifth diameter, the relationship of the diameters being such that the third diameter is greater than the fourth diameter, which is greater than the second diameter, which is greater than or equal to the fifth diameter, which is greater than the first diameter; and means in the groove for normally biasing the pressure ring transversely of the bore and to one side of the groove both to normally position at least a portion of the pressure ring in the path of the second contact and to normally effect axial misalignment between the aperture and both the bore and the path of the second contact, entry of the second contact into the aperture shifting the pressure ring against the action of the biasing means to substantially align the axis of the aperture with both the axis of the bore and the path of the second contact, such axial alignment and the action of the biasing means thereafter effecting intimate sliding engagement between the wall of the aperture and the second contact and between at least a portion of the wall of the bore and the second contact as long as the second contact is within the aperture.

5. The invention as claimed in claim 1, 2, 3 or 4, wherein:

the body is conductive.

6. The invention as claimed in claim 5, wherein:

the pressure ring is conductive.

7. The invention as claimed in claim 5, wherein:

the pressure ring is insulative.

8. The invention as claimed in claim 1 or 3, wherein the biasing means comprises:

a pre-stressed plate spring in the grooves which acts between the groove and the pressure ring, the pre-stressed plate spring being transverse to the axis of the bore.

9. The invention as claimed in claim 8, wherein:

the ends of the spring abut the interior surface of the groove and a portion of the spring intermediate the ends thereof abuts the exterior surface of the pressure ring.

10. The invention as claimed in claim 9, wherein:

the intimate sliding engagement between the wall of the aperture and the second contact occurs at a first location proximate the abutment between the spring and the pressure ring, and the intimate sliding engagement between the wall of the bore and the second contact occurs at a second location on the side of the bore generally diametrically opposite the first location.

11. The invention as claimed in claim 10, wherein:

the body is conductive.

12. The invention as claimed in claim 11, wherein:

the pressure ring is conductive.

13. The invention as claimed in claim 11, wherein:

the pressure ring is insulative.

14. The invention as claimed in claim 8, wherein:

the pressure ring is chamfered, bevelled, or rounded at the aperture to facilitate entry of the second contact into the aperture when the aperture and the path of the second contact are misaligned.

15. The invention as claimed in claim 2 or 4, wherein the biasing means comprises:

a pre-stressed plate spring in the groove which acts between the groove and the pressure ring to bias the pressure ring to one side of the groove, the pre-stressed plate spring being transverse to the axis of the bore.

16. The invention as claimed in claim 15, wherein:

the intimate sliding engagement between the wall of the aperture and the second contact occurs at a first location proximate the spring; and the intimate sliding engagement between the wall of the bore and the second contact occurs at a second location on the side of the bore generally diametrically opposite the first location.

17. The invention as claimed in claim 15, wherein:

the pressure ring is chamfered, bevelled, or rounded at the aperture to facilitate entry of the second contact into the aperture when the aperture and the path of the second contact are misaligned.

18. The invention as claimed in claim 16, wherein:

the body is conductive.

19. The invention as claimed in claim 18, wherein:

the pressure ring is conductive.

20. The invention as claimed in claim 18, wherein:

the pressure ring is insulative.

21. The invention as claimed in claim 1, 2, 3 or 4 wherein:

the bore is open at both ends, the pressure ring is between the ends of the bore, the second contact exits the end of the bore opposite the end in which it was previously received, after passing through the aperture, as the contacts disengage, the pressure ring is chamfered, bevelled, or rounded at the aperture to facilitate the entry of the second contact into the aperture when the aperture and the path of the second contact are misaligned, and the body, at the end of the bore into which the second contact is received, and the pressure ring are smoothly contoured.

* * * * *